US011571348B2

(12) United States Patent
VanBasten

(10) Patent No.: US 11,571,348 B2
(45) Date of Patent: Feb. 7, 2023

(54) MEDICAL ISOLATION TRANSPORT SYSTEM—MITS

(71) Applicant: Air Shelters USA, LLC, Hatboro, PA (US)

(72) Inventor: Willem VanBasten, Hatboro, PA (US)

(73) Assignee: AIR SHELTERS USA, LLC, Hatboro, PA (US)

( * ) Notice: Subject to any disclaimer, the term of this patent is extended or adjusted under 35 U.S.C. 154(b) by 66 days.

(21) Appl. No.: 16/564,460

(22) Filed: Sep. 9, 2019

(65) Prior Publication Data

US 2020/0246208 A1 Aug. 6, 2020

Related U.S. Application Data

(63) Continuation of application No. 15/345,401, filed on Nov. 7, 2016, now abandoned.

(60) Provisional application No. 62/251,355, filed on Nov. 5, 2015.

(51) Int. Cl.
*A61G 10/00* (2006.01)
*A61G 3/00* (2006.01)

(52) U.S. Cl.
CPC ..... *A61G 10/005* (2013.01); *A61G 3/008* (2013.01)

(58) Field of Classification Search
CPC ..... A61G 10/005; A61G 3/008; A61G 10/023
USPC ..... 600/21–22
See application file for complete search history.

(56) References Cited

U.S. PATENT DOCUMENTS 4,304,224 A * 12/1981 Fortney ..... B01L 1/04 128/201.29
4,736,762 A * 4/1988 Wayman ..... A61G 10/005 128/205.26
5,522,919 A * 6/1996 Sargent ..... B01D 46/02 95/273
5,864,767 A * 1/1999 Drumgoole ..... F42D 5/045 86/50
6,001,057 A * 12/1999 Bongiovanni ..... A62B 31/00 5/629
6,461,290 B1 * 10/2002 Reichman ..... A61G 10/005 5/312
8,007,351 B1 * 8/2011 Maloney ..... A61G 10/005 600/21
2004/0060589 A1 * 4/2004 Torres-Badash ..... E04H 15/20 135/156

(Continued)

OTHER PUBLICATIONS

Special Planes Are Lifeline for Ebola Patients—Phoenix Air and The Wall Street Journal; Cameron McWhirter and Betsy McKay, Dan Ion. Mar. 13, 2015. (Year: 2015).*

(Continued)

*Primary Examiner* — Sunita Reddy
(74) *Attorney, Agent, or Firm* — Whiteford, Taylor & Preston, LLP; Peter J. Davis

(57) ABSTRACT

A flexible rapid deployable system that may be used create an isolated space within a medical transport vehicle for use when transporting infected or contaminated patients, including a flexible tent-like liner that creates a room inside the vehicle where both the patient and medical personnel can be isolated and that isolates contaminants within and a filtration system capable of producing the required air flow to maintain a negative pressurized isolated environment, sized to effectively accomplish this for the isolated cubic space.

3 Claims, 5 Drawing Sheets

(56) References Cited

U.S. PATENT DOCUMENTS

| | | | | |
|---|---|---|---|---|
| 2006/0247487 | A1* | 11/2006 | Arts | A61G 11/009 600/21 |
| 2007/0056593 | A1* | 3/2007 | Kubicsko | B08B 15/026 128/846 |
| 2007/0193132 | A1* | 8/2007 | Roscioli | B32B 7/12 52/169.6 |
| 2008/0120919 | A1* | 5/2008 | VanBasten | E04H 15/20 52/2.17 |
| 2008/0171935 | A1* | 7/2008 | McKnight | A61B 6/04 600/415 |
| 2012/0037622 | A1* | 2/2012 | Cantin | E04B 1/34357 220/23.83 |
| 2012/0136196 | A1* | 5/2012 | Foxall | A61B 5/055 600/21 |
| 2014/0290162 | A1* | 10/2014 | Tanimoto | B25J 21/02 52/234 |
| 2017/0079860 | A1* | 3/2017 | McLoughlin | B60R 16/033 |
| 2019/0352923 | A1* | 11/2019 | Harrison | E04H 15/06 |

OTHER PUBLICATIONS

"Technical manual:Heavy-Duty Inflatable Shelter System" by Western Shelter, 2015, pp. 1-27 (see attached) (Year: 2015).*

English MachineTranslation of CN 204468471 U (see attached) (Year: 2015).*

* cited by examiner

MEDICAL ISOLATION TRANSPORT SYSTEM—MITS

FIELD OF THE INVENTION

The present invention relates to medical isolation systems.

BACKGROUND OF THE INVENTION

Currently available mobile personal isolation systems only isolate the patient on a stretcher, bed or exam table. These systems only allow access to the patient via integrated gloves and thus makes taking care of the patient difficult. This is especially the case when life support equipment needs to be used or other invasive procedures need to be performed. In hospitals, patients are placed in Isolation Rooms. This is a specially equipped room that is negative pressurized with the use of medical hepa filtration systems that scrub and evacuate the air. When an infected or contaminated patients requires transport and medical care, a medic will accompany the patient in personal protective gear. The transport vehicle, however, will become contaminated possibly posing a serious health risk to others and requiring extensive decontamination of the vehicle.

SUMMARY OF THE INVENTION

The present invention was developed to answer the growing need for isolating infected and/or contaminated patients that require transportation via ambulance. The medical isolation transport system ("MITS") of the present invention is a flexible rapid deployable system that may be used create an isolated space within a medical transport vehicle for use when transporting infected or contaminated patients. The MITS is essentially a rapid and easily deployed liner system for use in the transport vehicle. A flexible tent-like liner creates a room inside the vehicle where both the patient and medical personnel can be isolated and contain contaminants within. The system may be connected to a portable medical high efficiency particulate air (HEPA) filtration system to create a negative pressure environment so that contaminants remain inside the room. Air flows thru the filtration system where it is essentially "scrubbed" of contaminants. The air discharged from the HEPA system is then exhausted outside the vehicle. Clean ambient air flows into the room via adjustable vents. The in-flow or "make-up" air is restricted as compared to the outflow via the HEPA scrubber, thus creating a slight negative pressure environment. It is essential that the room remains deployed and not collapse on itself as it is negative pressurized. The MITS accomplishes this by an integrated air structure that is inflated and forms the interior shape of the vehicle. The MITS will be sized to fit specific transport vehicles such as ambulance or bus.

DESCRIPTION OF THE DRAWINGS

The subsequent description of the preferred embodiments of the present invention refers to the attached drawings, wherein.

DETAILED DESCRIPTION OF THE INVENTION

Figure 1:
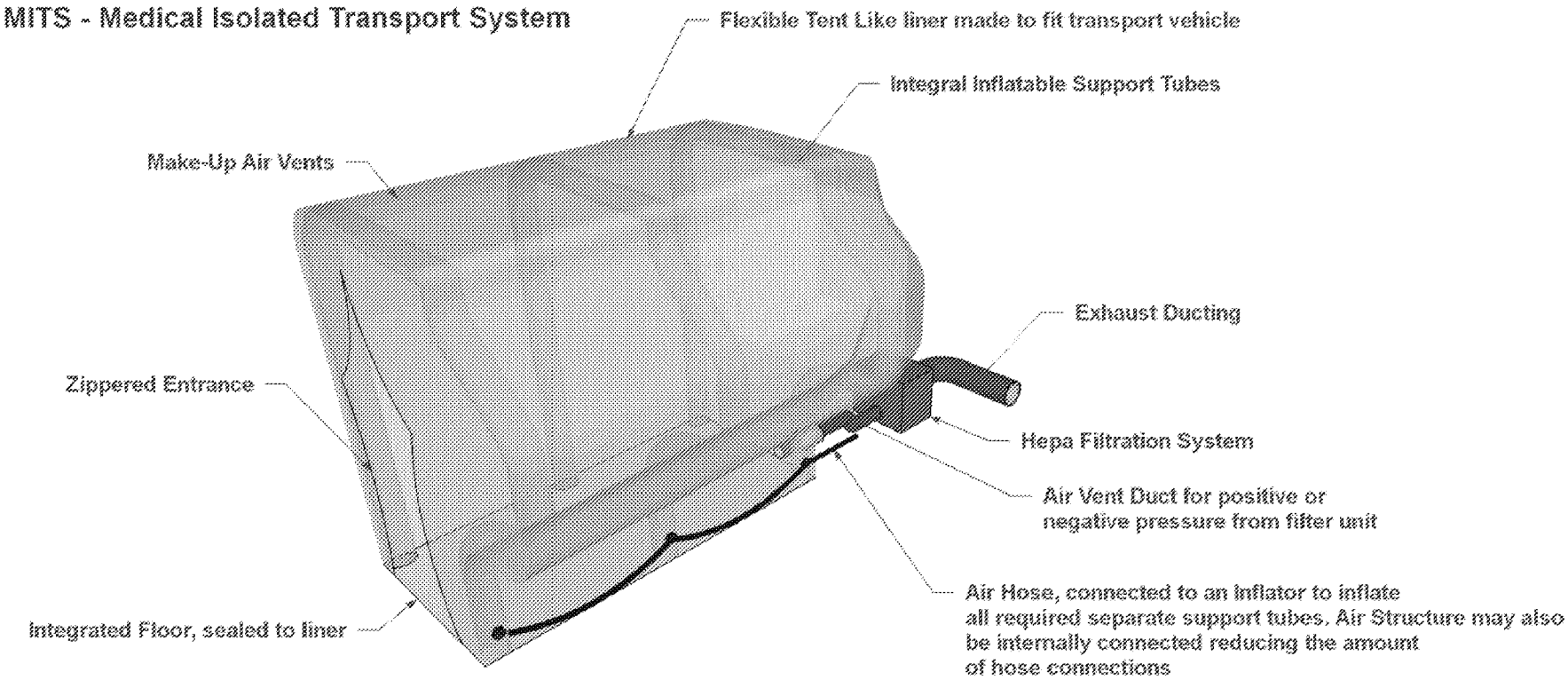
FIG. 1 is a perspective view of a flexible tent-like liner with inflatable support tubes, inflation, and air circulation/filtration systems, according to an embodiment of the invention
Figure 2:
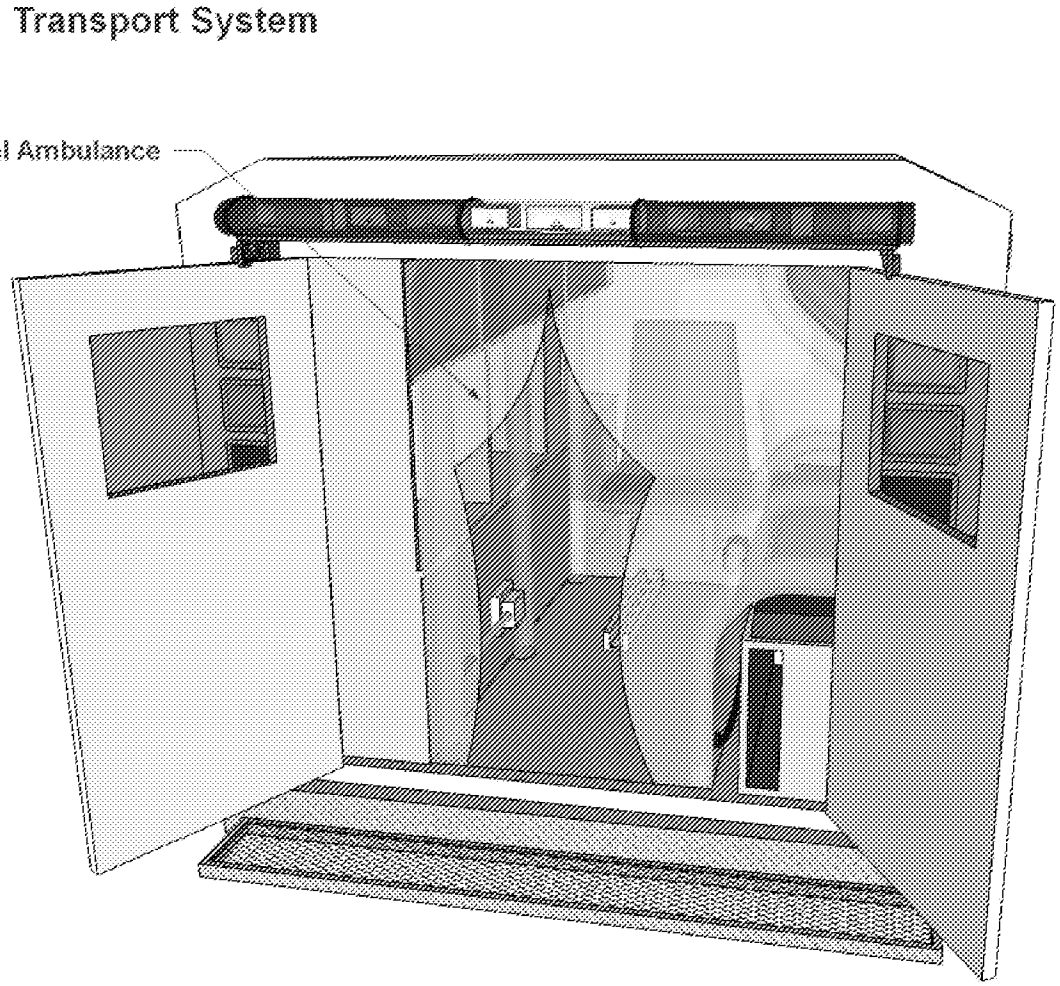
FIG. 2 is a rear view of an embodiment of the MITS of the invention deployed inside of a standard ambulance/rescue squad vehicle.
Figure 3:
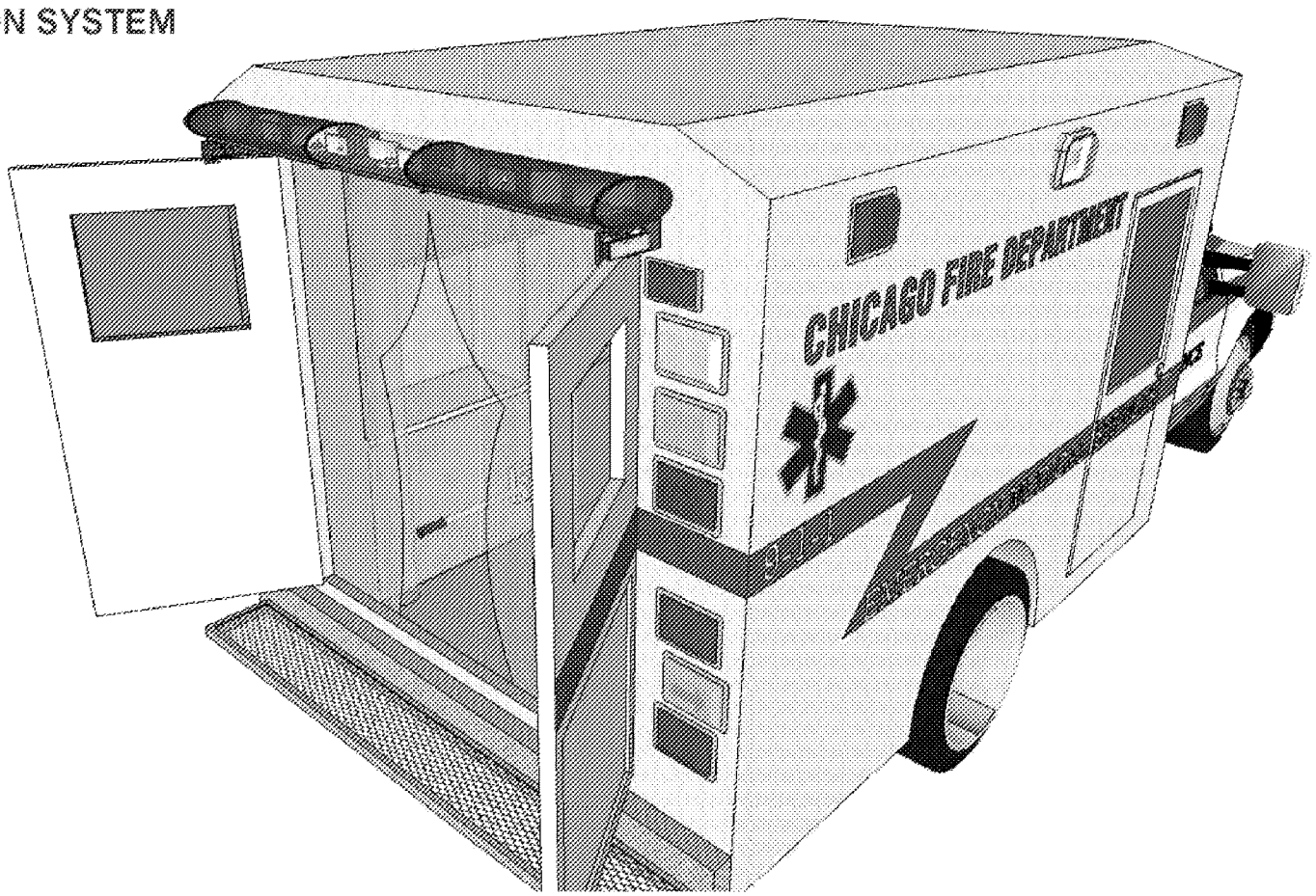
FIG. 3 is a perspective view of an embodiment of the MITS of the invention deployed inside of a standard ambulance/rescue squad vehicle.
Figure 4:
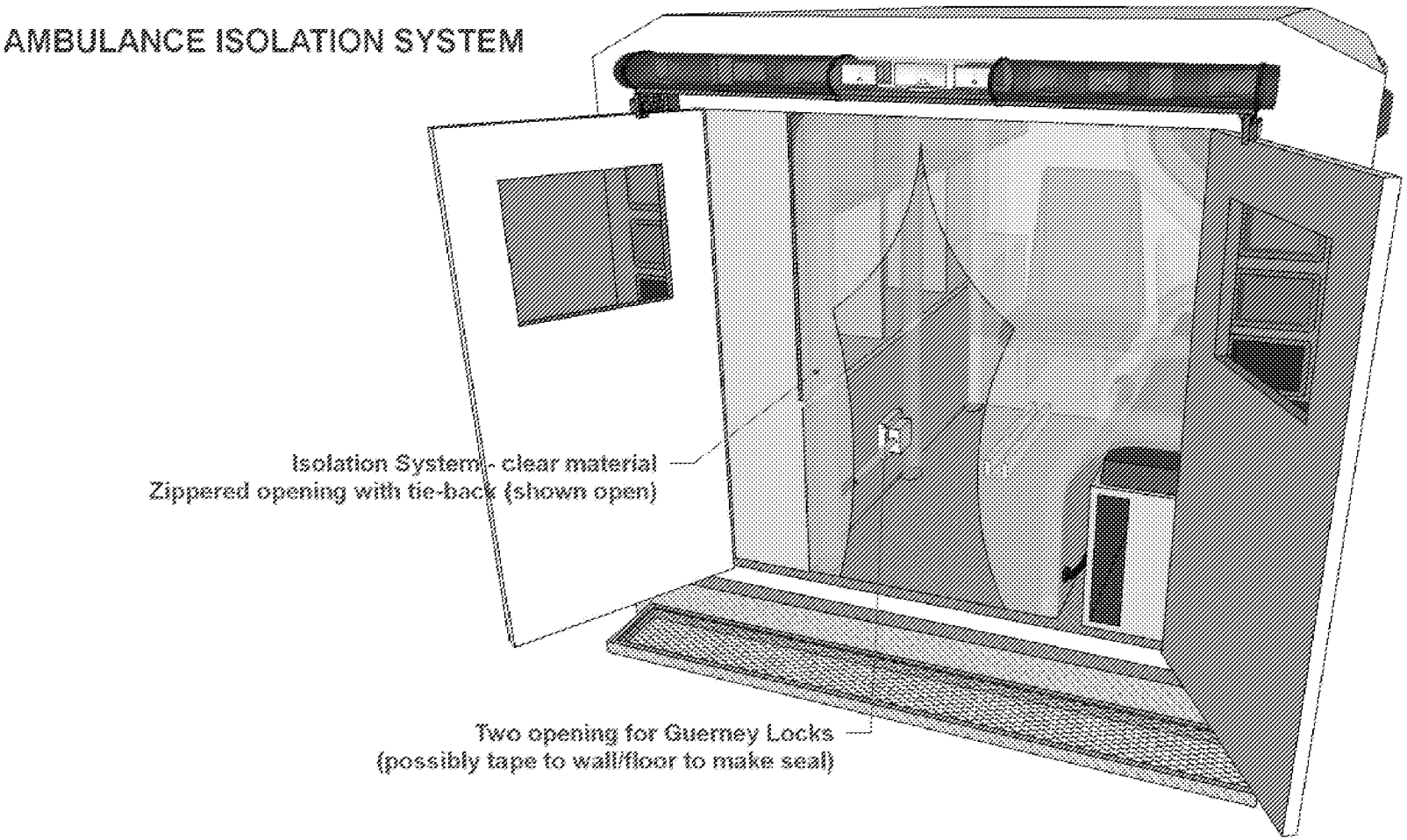
FIG. 4 is a rear view of another embodiment of the MITS of the invention deployed inside of a standard ambulance/rescue squad vehicle.
Figure 5:
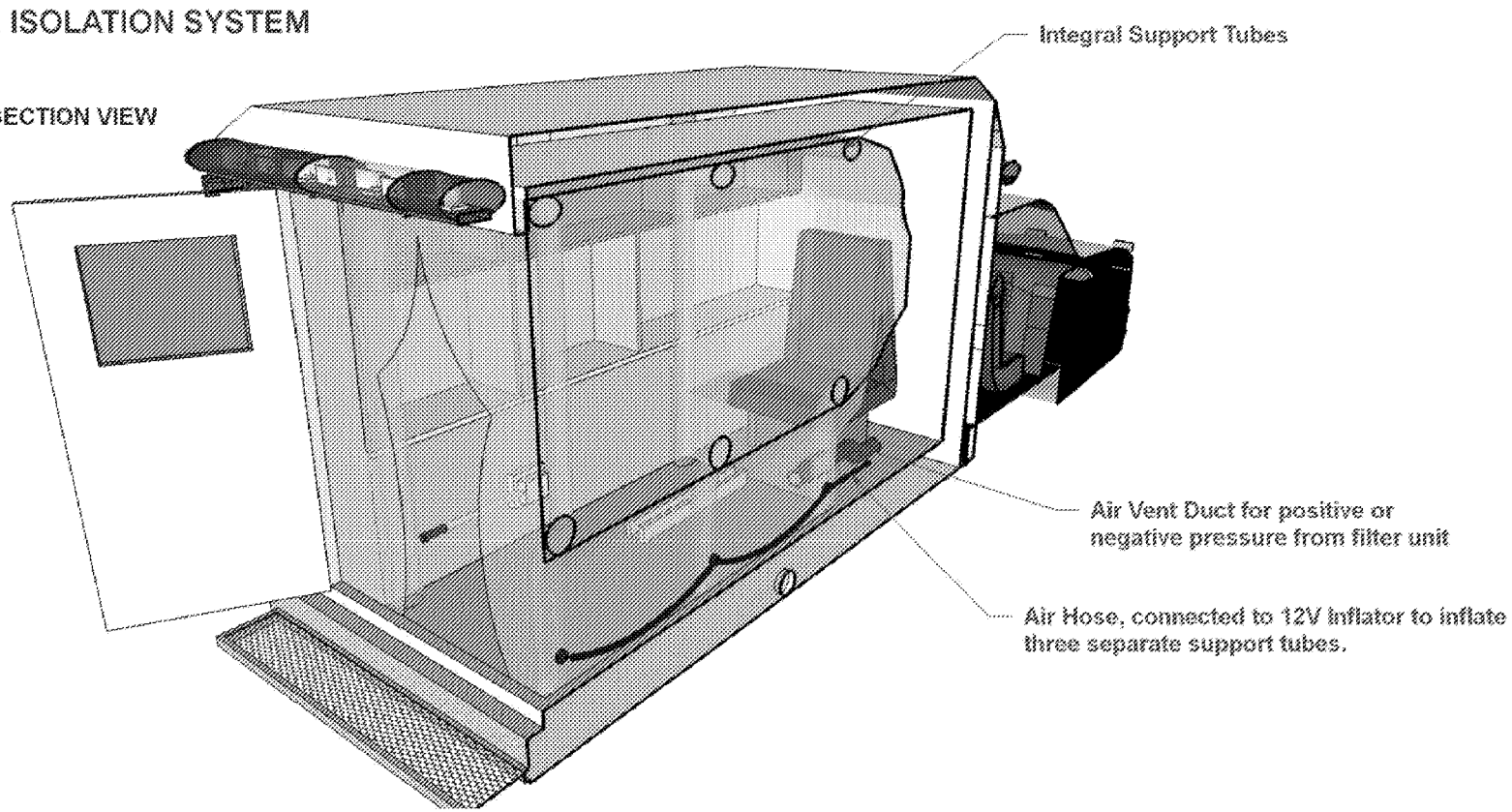
FIG. 5 is cut-away cross-section view of an embodiment of the MITS of the invention deployed inside of a standard ambulance/rescue squad vehicle.

Referring to the figures, an exemplary MITS according to the invention may have the following components:

- Flexible tent like liner made to fit into and create a treatment-space enclosure inside an emergency vehicle;
- A separate or integrated structure system to maintain the tented space
- At least one zippered entrance
- A filtration system capable of producing the required air flow to maintain a negative pressurized isolated environment, sized to effectively accomplish this for the isolated cubic space.

The MITS is a flexible cost effective system to create an isolated space within a medical transport vehicle. The system is easily deployed and installed within minutes within the vehicle. The liner allows for a stretcher to be placed and locked for safe transport. The system will allow for medical personnel to be with the patient in a controlled environment. The isolated environment ensures safety to others as well as protecting the vehicle from contamination, which reduces the need for costly and time consuming decontamination. The system will make it possible to transport contaminated patients and contain the hazards associated with doing so. The MITS is compact and lightweight when stored. Most if not all of the liner system will be made with clear materials, allowing light form the vehicle to illuminate the isolated environment. Make-Up Air vent(s) will be placed near the vehicle HVAC ducts so heated or cooled air can flow from the vehicle into the isolated tent like negative pressure environment. The integrated and sealed floor will be capable of containing bodily or other spilled fluids. The mechanical systems consisting of the filtration system and, in the case of the preferred embodiment, an inflator system to erect the tubular structure will be reusable. The tent like isolated environment will be deemed disposable. Connections between the transport isolation room and the filtration system as well as the air hoses for the inflatable support structure in the preferred embodiment will be with flexible ducting and hoses allowing for easy placement of the filtration system and the air pump.

The invention claimed is:

1. A medical isolation transport system comprising:

a collapsible flexible liner, having a top, a floor, walls, and a closable entry point, sized and tailored to fit inside and line an interior of a medical emergency transport vehicle while all doors of said medical emergency transport vehicle are closed, wherein at least one of the top and the walls of the collapsible flexible liner contact the interior of the medical emergency transport vehicle;

wherein said collapsible flexible liner, including said top, said floor, said walls, and said closable entry point, is configured as a medical isolation chamber in said interior of said medical emergency transport vehicle while said doors of said medical emergency transport vehicle are closed and said medical emergency transport vehicle is moving, said closable entry point sized to permit entry and exit of a patient and medical personnel;

an air circulation system configured to create negative pressure in an interior of said medical isolation chamber, said air circulation system comprising a high efficiency particulate air (HEPA) medical filtration system;

said medical isolation transport system including make-up air vents located in the at least one of the top and the walls of the collapsible flexible liner and configured to allow heated or cooled air to flow from HVAC (heating, ventilation, and air conditioning) ducts of the medical emergency transport vehicle into the medical isolation chamber;

a support system sufficient to maintain said collapsible flexible liner in an erected state notwithstanding said negative pressure in said interior of said medical isolation chamber; and said support system comprising a plurality of integral inflatable support tubes located and arranged to support the top and walls of said collapsible flexible liner against a force of said negative pressure in said interior of said medical isolation chamber.

2. The medical isolation transport system according to claim 1, wherein said collapsible flexible liner is sized to permit both the patient and the medical personnel to be in said medical emergency transport vehicle while said medical emergency transport vehicle is moving, but isolated from a driver's cabin and/or other areas in the medical emergency transport vehicle outside the flexible liner.

3. A medical isolation transport system comprising:

a collapsible flexible liner, having a top, a floor, walls, and a closable entry point, sized and tailored to fit inside and line an interior of a medical emergency transport vehicle while all doors of said medical emergency transport vehicle are closed, wherein said collapsible flexible liner, including said top, said floor, said walls, and said closable entry point, is configured as a medical isolation chamber in said interior of said medical emergency transport vehicle while said doors of said medical emergency transport vehicle are closed and said medical emergency transport vehicle is moving, said closable entry point sized to permit entry and exit of a patient and medical personnel;

an air circulation system configured to create negative pressure in an interior of said medical isolation chamber, said air circulation system comprising a high efficiency particulate air (HEPA) medical filtration system;

said medical isolation transport system including make-up air vents configured to be placed adjacent HVAC (heating, ventilation, and air conditioning) ducts of the medical emergency transport vehicle allowing heated or cooled air to flow from the medical emergency transport vehicle into the medical isolation chamber;

a support system sufficient to maintain said collapsible flexible liner in an erected state notwithstanding said negative pressure in said interior of said medical isolation chamber; and said support system comprising a plurality of integral inflatable support tubes located and arranged to support the top and walls of said collapsible flexible liner against a force of said negative pressure in said interior of said medical isolation chamber.

* * * * *